US007900910B2

(12) United States Patent
Horiuchi et al.

(10) Patent No.: US 7,900,910 B2
(45) Date of Patent: Mar. 8, 2011

(54) SHEET PACKAGE

(75) Inventors: Takashi Horiuchi, Kariya (JP); Yasunori Nakamura, Shinshiro (JP); Yoshikatsu Suito, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 502 days.

(21) Appl. No.: 11/978,767

(22) Filed: Oct. 30, 2007

(65) Prior Publication Data

US 2009/0194448 A1 Aug. 6, 2009

(30) Foreign Application Priority Data

Oct. 31, 2006 (JP) ..... 2006-297022

(51) Int. Cl.
*B65H 1/00* (2006.01)

(52) U.S. Cl. ..... 271/145; 271/162; 206/449; 206/453

(58) Field of Classification Search ..... 271/145, 271/162; 206/449, 453
See application file for complete search history.

(56) References Cited

U.S. PATENT DOCUMENTS

| | | | | |
|---|---|---|---|---|
| 3,727,823 | A * | 4/1973 | Sullivan | 206/449 |
| 3,767,188 | A * | 10/1973 | Rosenberg et al. | 271/145 |
| 5,314,179 | A | 5/1994 | Oda et al. | |
| 6,227,732 | B1 | 5/2001 | Higuchi et al. | |
| 6,318,918 | B1 | 11/2001 | Sasaki et al. | |
| 6,357,739 | B2 | 3/2002 | Sasaki et al. | |
| 6,431,358 | B1 | 8/2002 | Sasaki et al. | |
| 6,460,845 | B1 | 10/2002 | Sasaki et al. | |
| 6,561,506 | B2 | 5/2003 | Sasaki et al. | |
| 7,281,873 | B2 * | 10/2007 | Yamamoto et al. | 400/624 |
| 7,568,851 | B2 * | 8/2009 | Yamamoto et al. | 400/624 |
| 2001/0011795 | A1 * | 8/2001 | Ohtsuka et al. | 271/145 |
| 2005/0230902 | A1 | 10/2005 | Sugiyama et al. | |
| 2006/0012110 | A1 * | 1/2006 | Yamamoto et al. | 271/145 |
| 2008/0099359 | A1 | 5/2008 | Suito et al. | |

FOREIGN PATENT DOCUMENTS

| | | |
|---|---|---|
| EP | 0941862 | 9/1999 |
| EP | 1 491 472 A | 12/2004 |
| JP | 54067973 | 5/1979 |
| JP | 60-204549 | 10/1985 |
| JP | 5105246 | 4/1993 |
| JP | 11-11701 | 1/1999 |
| JP | 11292310 | 10/1999 |
| JP | 2000 203725 A | 7/2000 |
| JP | 2003-159843 | 6/2003 |
| JP | 2003276864 | 10/2003 |
| JP | 2003285939 | 10/2003 |
| WO | 9947362 | 9/1999 |
| WO | WO 03/080485 | 10/2003 |

* cited by examiner

*Primary Examiner* — David H Bollinger
(74) *Attorney, Agent, or Firm* — Day Pitney LLP

(57) ABSTRACT

A package member (8) of a sheet package has a cut-in portion (54) which is formed by cutting it to a predetermined length from a cutout portion (53), between a side wall portion (41) and a first wrapping portion (50). Accordingly, distortion (movement) of the first wrapping portion (50) can be facilitated and pressing of sheets stored in the sheet package against a pickup roller can be achieved with an adequate degree of force.

7 Claims, 20 Drawing Sheets

SHEET PACKAGE

CROSS-REFERENCE TO RELATED APPLICATION

This Application claims priority from Japanese Patent Application No. 2006-297022, filed Oct. 31, 2006, the disclosure of which is hereby incorporated by reference in its entirety.

BACKGROUND OF THE INVENTION

The present disclosure relates to a sheet package, and more particularly to a sheet package that has a package member to protect an exterior of a stack of sheets, and that can be loaded in a printer together with the package member.

Conventionally, a sheet package has been known which stores a stack of sheets in a box-like package member. When the sheets are used for printing, a lid portion of the package member may be opened and folded back to the opposite side and the sheets may be set in the printer together with the packaging member (see, for example, Japanese Patent Application Laid-Open Publication No. 2003-285939). Because this conventional sheet package allows users to handle a plurality of sheets in the unit of a package, the usability is improved. Moreover, because the sheet package can protect sheets inside by covering them with the package member, the sheet package is especially useful when heat-sensitive sheets, which are particularly susceptible to light and heat, are employed.

The conventional sheet package has a rectangular wall portion which extends from a bottom portion in such a way that a shorter side of the rectangular wall portion is in contact with the lower end (the end on the opposite side to an ejection direction of the sheet) of the bottom portion when the package is spread out. When the rectangular wall portion is folded, the wall portion faces the bottom portion on which stacked sheets are to be placed and covers an upper face of the stacked sheets.

However, there has been a problem with the conventional sheet package that, if the size of sheets stored in the sheet package is enlarged, the length in the longitudinal direction of the package member is increased, and thus, a sheet material from which the package member is to be cut out is enlarged. As a result, the amount of sheet material to be cut off to be wasted is also increased. Thus, it may be possible to connect the rectangular wall portion that covers the upper face of the stacked sheets to the side end of the bottom portion (the direction perpendicular to the sheet ejection direction) rather than to the rear end of the bottom portion and to then fold the rectangular wall portion to cover the upper face of the stacked sheets.

However, in a printer in which a sheet package of the above-described structure is set, it is necessary to press the rectangular wall portion of the sheet package by a pressing member provided in the printer in order to press stored sheets against a sheet-feeding roller. Thus, when the rectangular wall portion and the bottom portion are connected via a side end as described above, a problem has arisen that movement of the rectangular wall portion is restricted, and that in consequence the degree of pressing force required for pressing the sheet against the sheet-feeding roller has not been adequate.

SUMMARY

The present invention has been achieved to solve the above-described problems, and an object of the invention is to provide a sheet package having a structure with which sheets stored in the sheet package can be pressed against a sheet-feeding roller with an adequate degree of pressing force.

The present invention provides a sheet package that can be set in a printer for supplying the printer with sheets as print media and that includes a stack of sheets and a package member covering an exterior of the stack of sheets, wherein the package member includes a rectangular first portion covering a part of one face of the stack of sheets in a stacking direction, a second portion covering the other face of the stack of sheets on the other side in the stacking direction and that facing the first portion, a third portion connecting with the second portion via one of a pair of side ends of the first portion and covering a side face of the stack of sheets, and a cut-in portion formed on a boundary between the first portion and the third portion or on a boundary between the second portion and the third portion in a predetermined length from an end on a side that is pressed by a pressing member of the printer in order to press an exposed portion of the stack of sheets exposed from the package member against a sheet-feed roller of the printer when the sheet package is set in the printer.

BRIEF DESCRIPTION OF THE DRAWINGS

Exemplary embodiments of the disclosure will be described in detail below with reference to the accompanying drawings in which.

DETAILED DESCRIPTION OF THE EXEMPLARY EMBODIMENTS

Figure 1:
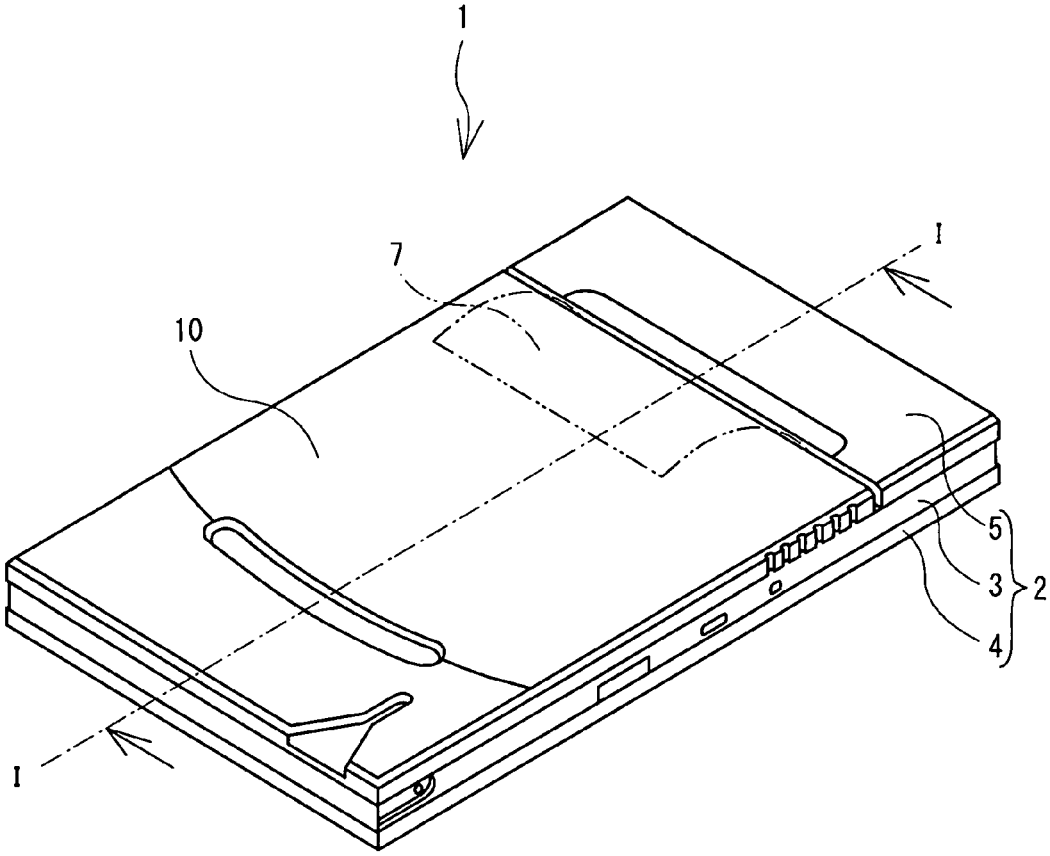
FIG. 1 is a perspective view of a printer.

First, a structure of a printer 1 loaded with a sheet package 9 according to a first embodiment of the present disclosure will be described with reference to FIGS. 1-4. As shown in FIG. 1, the printer 1 has a flat rectangular parallelepiped configuration which is rectangular in its plan view (slightly larger than A6 size) and which has a thickness of about 2 cm. A body case 2 of the printer 1 includes a frame 3, a lower cover 4 which covers the bottom of the frame 3, an upper cover 5 which covers a part of the top of the frame 3, and a lid 10 which can be opened and closed. The frame 3 and the lower cover 4 both have a rectangular shape in a plan view.

Figure 2:
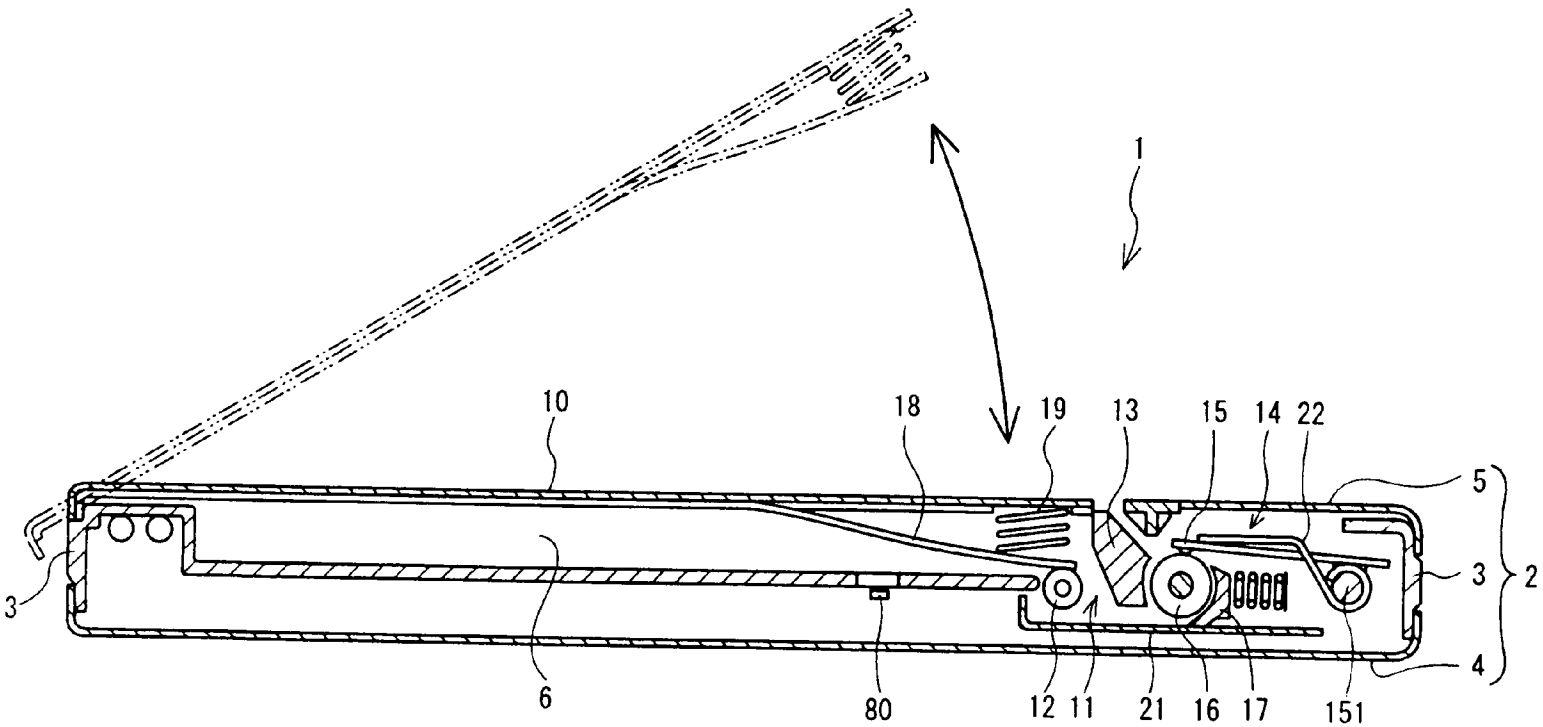
FIG. 2 is a sectional view taken along a line I-I in FIG. 1.
Figure 3:
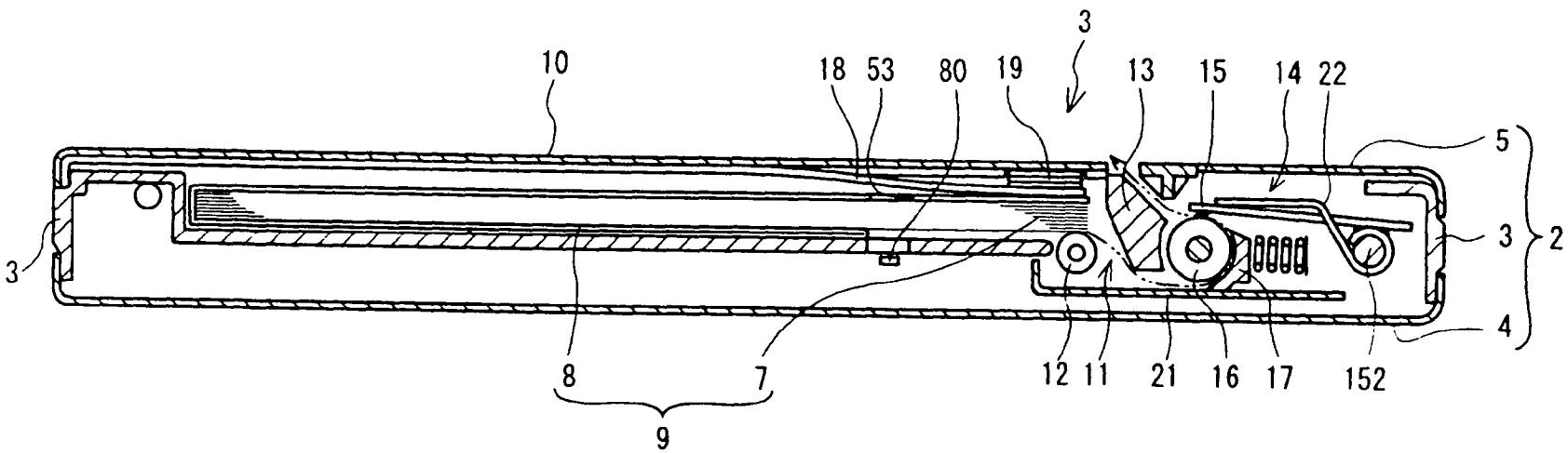
FIG. 3 is a diagram showing a sheet package set in a sheet storage portion.

As shown in FIGS. 2 and 3, a printer mechanism portion 14 is disposed in the interior of an end portion (upper end portion in FIGS. 2 and 3) of the printer 1. The top of the printer mechanism portion 14 is covered with the upper cover 5 which has a rectangular shape in its plan view. The printer mechanism portion 14 includes a thermal head 15, a platen roller 16 and a sheet guide 17. A sheet storage portion 6 is formed in the upper portion of the frame 3 which is not covered with the upper cover 5. The top of the sheet storage portion 6 is covered with a lid 10, which is rectangular in its plan view, and this lid 10 can be opened and closed as shown in FIG. 2.

The sheet storage portion 6 can store a sheet package 9 which contains a plurality of heat-sensitive sheets 7 such as cut sheets of A6 or A7 size inside its package member 8 as shown in FIG. 3. Further, the body case 2 is provided with a lock mechanism (not shown) which allows the lid 10 to be closed and locked as shown in FIG. 3, with the sheet package 9 set in the sheet storage portion 6.

Figure 4:
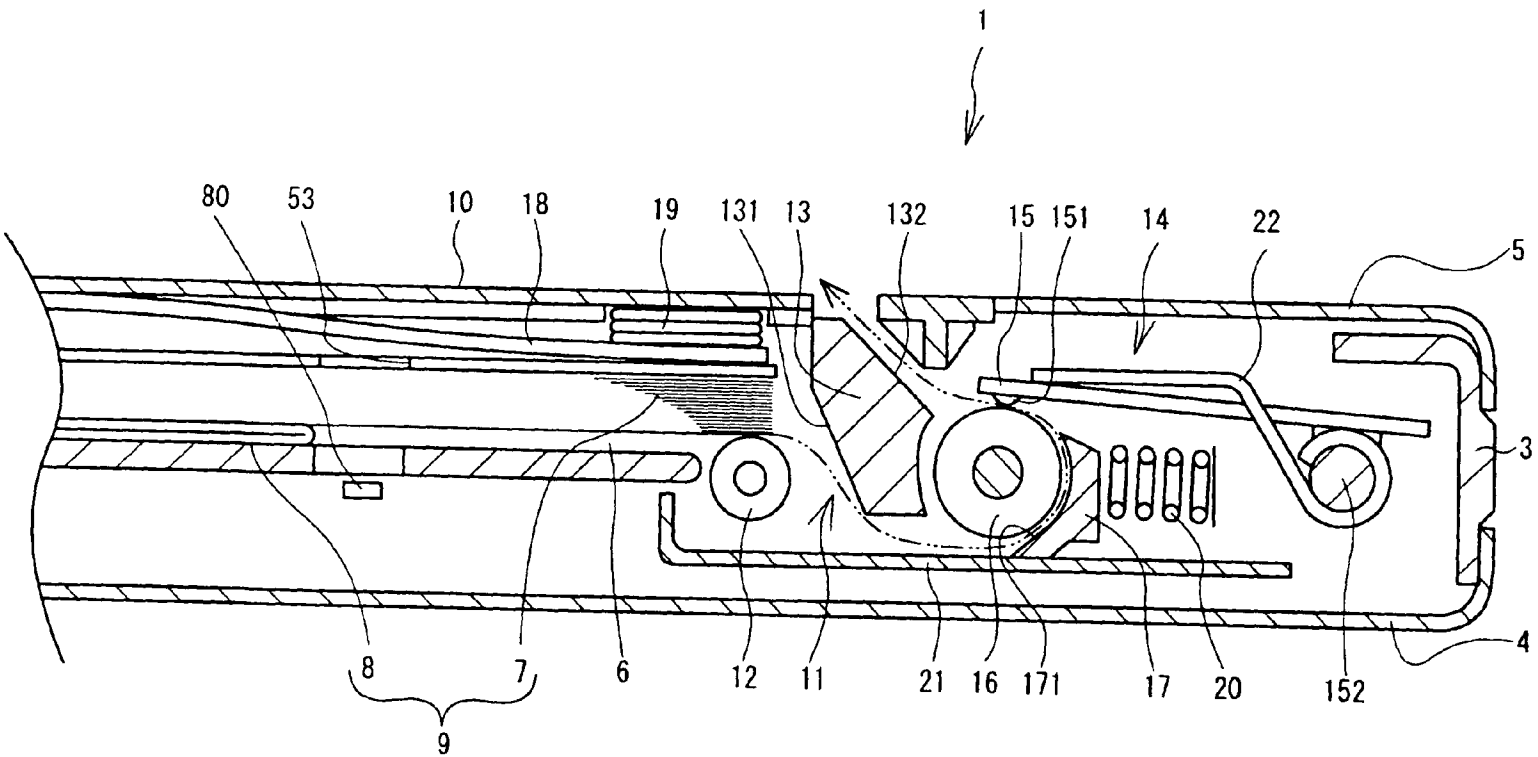
FIG. 4 is an enlarged sectional view showing details of a sheet separation portion and a printer mechanism portion.

As shown in FIG. 4, a sheet separation portion 11 is provided next to one end of the sheet storage portion 6, the one end being close to the printer mechanism portion 14. The sheet separation portion 11 includes a pickup roller 12 and a separation block 13. In addition, on an inner surface of the lid 10 facing the sheet storage portion 6, a pressure plate 18 is supported rotatably. A coil-like pressure spring 19 is interposed between the pressure plate 18 and the lid 10 and constantly presses the pressure plate 18 in a downward direction (direction towards the pickup roller 12).

The sheet package 9 is loaded in the sheet storage portion 6 in such a way that the lower surface of a lowermost sheet of the stacked sheets 7 is partially exposed from the package member 8. The sheets 7 are stacked in the package member 8 with their print side facing downwards. Then, when the lid 10 is closed and locked, the pressure plate 18, which is pressed downwards by the pressure spring 19, presses the exposed portion of the sheet 7 (lowermost sheet) against the pickup roller 12 in such a way that the lower surface of the sheet 7 makes contact with the pickup roller 12.

As shown in FIG. 4, the separation block 13 is provided in the vicinity of and facing the pickup roller 12. The separation block 13 has a separation guide surface 131 that is tilted with respect to the sheet-feeding direction of the pickup roller 12. In the sheet separation portion 11 of this structure, when the pickup roller 12 is rotated, a frictional carrying force is applied to the lowermost sheet of the stacked sheets 7 which is in contact with the pickup roller 12. Then, only one of the sheets 7 that is located at the bottom of the stack is separated and fed by the frictional carrying force coupled with separating action of the separation guide face 131 of the separation block 13.

Next, the printer mechanism portion 14 will be described. As shown in FIG. 4, the platen roller 16 is provided across the separation block 13 from the pickup roller 12. The platen roller 16 can be rotated by a motor (not shown). The sheet guide 17 is placed in the vicinity of an exterior peripheral surface of the platen roller 16. The sheet guide 17 has a concavely curved sliding surface 171 formed along the exterior peripheral surface of the cylindrical platen roller 16. Accordingly, the sheet guide 17 has a laterally-directed U-shaped section. A pressure coil spring 20 is provided between the sheet guide 17 and the body case 2 so as to press the sliding surface 171 towards the exterior peripheral surface of the platen roller 16.

In the printer 1 having such a structure, one of the sheets 7 separated by the aforementioned sheet separation portion 11 is fed by the pickup roller 12, and passes through a gap between the bottom end of the separation block 13 and a guide plate 21 for guiding the sheet 7 towards the platen roller 16. Then, the sheet 7 is guided by the guide plate 21 and fed into a gap between the platen roller 16 and the paper guide 17 from the lower side of the platen roller 16. Further, the sheet 7 is fed by rotational driving of the platen roller 16 through a gap between the exterior peripheral surface of the platen roller 16 and the sliding surface 171 of the sheet guide 171 and inverted in such a way that it forms a laterally-directed U-shape on the way and then, reaches the top of the platen roller 16 with its print side facing upwards.

As shown in FIG. 4, the thermal head 15 is placed on the top of the platen roller 16, and has a heating element portion 151 which is a printing portion. The thermal head 15 is provided rotatably around a rotation shaft 152, by which the heating element portion 151 can contact and separate from the top of the platen roller 16. Such a structure helps prevent the thermal head from becoming an obstacle when it is necessary to remove a sheet that has been jammed between the platen roller 16 and the sheet guide 17.

As shown in FIG. 4, an end of a spring 22 of a torsion coil spring type is attached to the thermal head 15. The spring 22 constantly pushes the thermal head 15 so that the heating element portion 151 of the thermal head 15 approaches the top of the platen roller 16. With this structure, the heating element portion 151 of the thermal head 15 makes contact with the print side of the sheet 7 that is fed by the platen roller 16 with its print side facing upwards as described above, and printing is carried out at the contact position.

The thermal head 15 is of a line head type and capable of printing an arbitrary character or image on heat-sensitive type sheets 7 that are fed, on a line by line basis, the line extending in a direction perpendicular to the feed direction of the sheets 7. A printing width of a single line is set to be substantially equal to the width of the sheet 7 which is a print medium. By employing thermal head 15 as the print head and heat-sensitive sheets as the print media, the use of consumer products such as ink and an ink ribbon becomes unnecessary, and thus a need for a mechanism for supplying ink is eliminated. The printer 1 can thus be designed in a compact configuration. As heat-sensitive sheets, a variety of sheets are available. For example, those of a heat-sensitive coloring type that has a color layer which becomes colored when heated by the thermal head 15, and those of heat-sensitive perforation type that has a perforation layer which is an over layer on a base layer and becomes perforated by heating, can be used.

The separation block 13 has a sheet ejection guide surface 132 which is tilted relative to the sheet-feed direction of the platen roller 16. With this structure, the sheet 7 that has been through printing by the heating element portion 151 of the thermal head 15 is guided by the sheet ejection guide face 132, and ejected upwards above the lid 10 from a gap between the upper cover 5 of the body case 2 and the lid 10.

Figure 5:
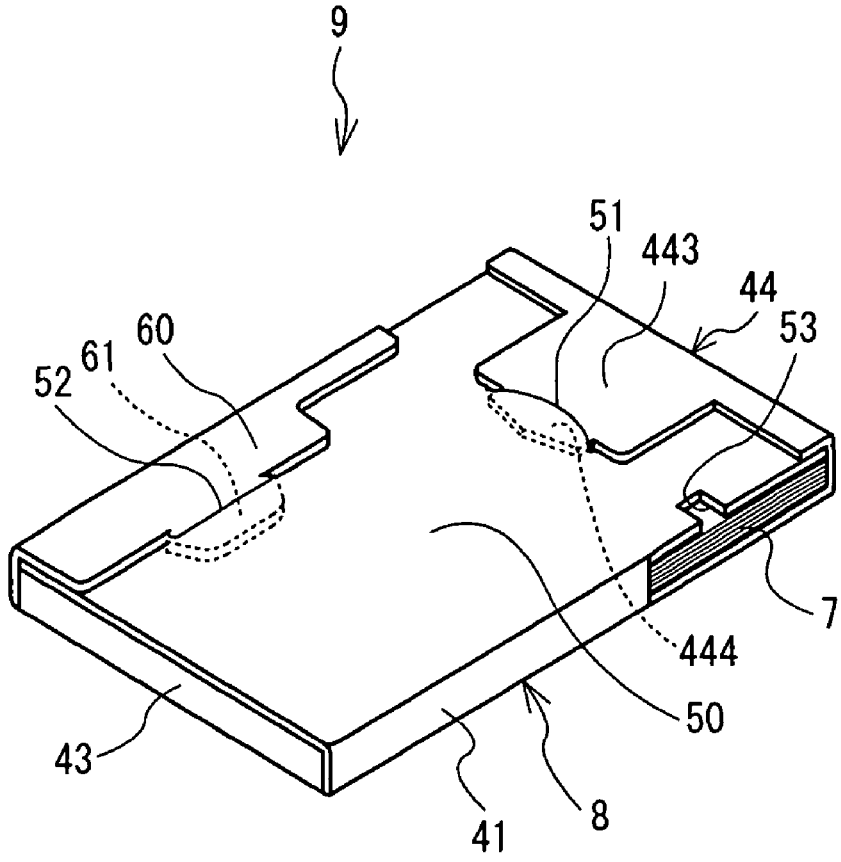
FIG. 5 is a perspective view of the sheet package according to a first embodiment.
Figure 6:
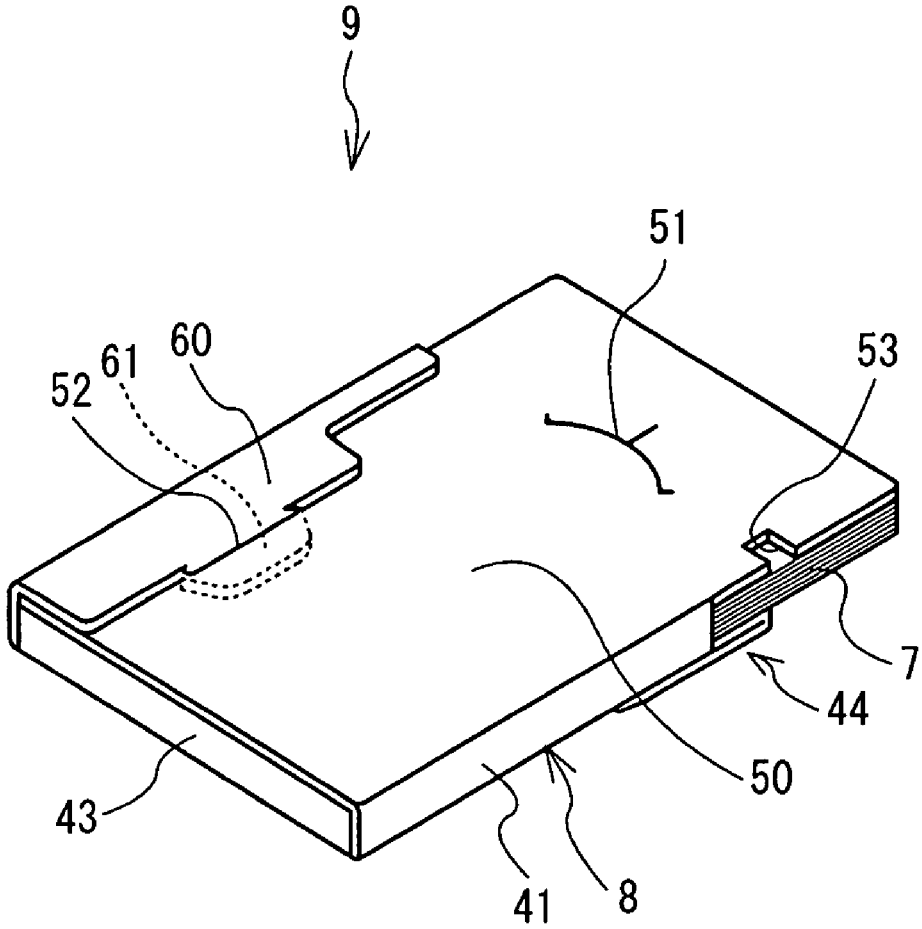
FIG. 6 is a perspective view of the sheet package when a lid portion is opened.
Figure 7:
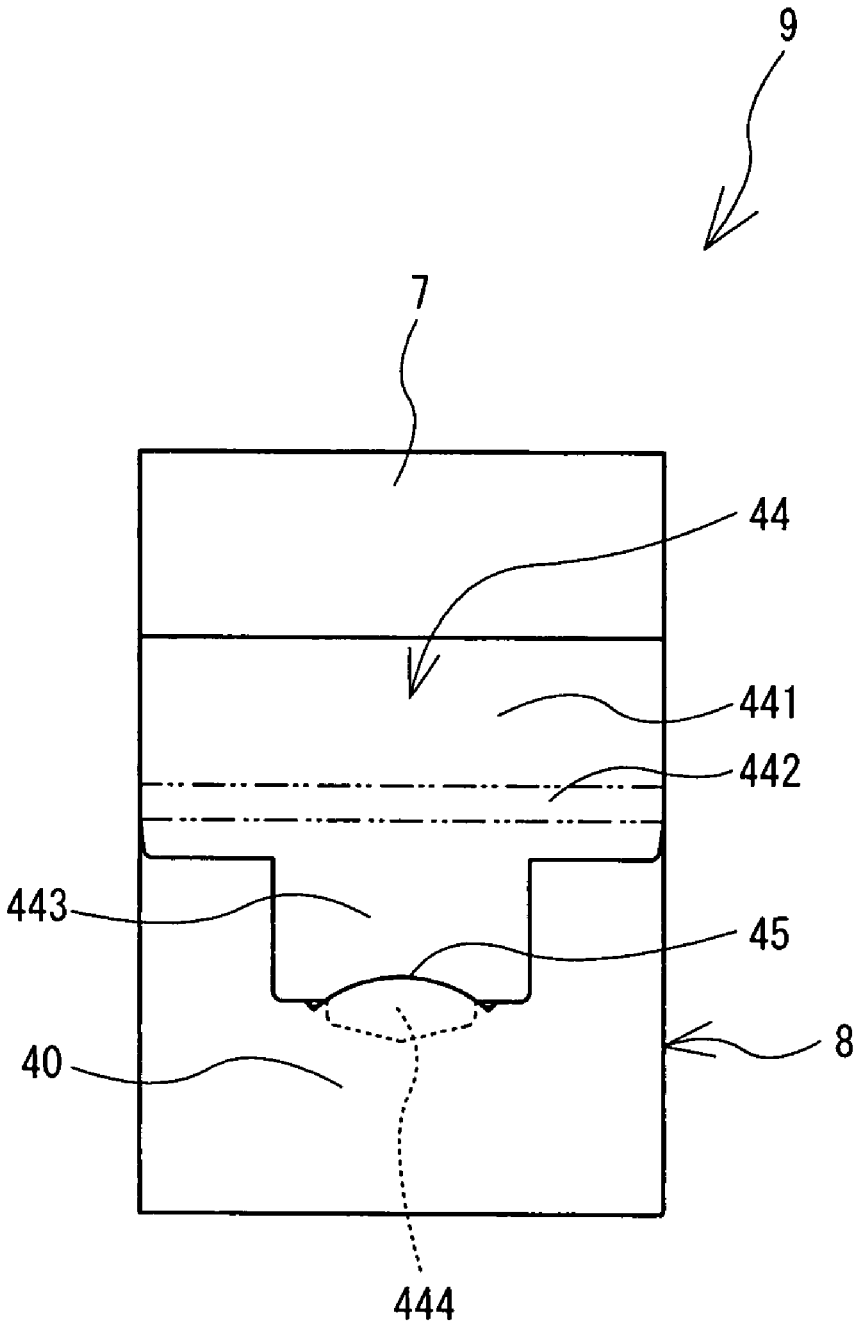
FIG. 7 is a bottom view of the sheet package when the lid portion is opened.

Next, the sheet package 9 according to the first embodiment of the present disclosure, which is to be set in the printer 1, will be described in detail with reference to FIGS. 5-12. As shown in FIG. 5, the sheet package 9 is manufactured by folding a rectangular thin package member 8 into a box-like shape. In the sheet package 9, a plurality of sheets (print media) 7 are stacked and stored. The sheets 7 are cut-sheet type heat-sensitive sheets of a small size, for example, of an A6-A7 size. A user purchases a sheet package 9 sold in a box-like shape as shown in FIG. 5, and then, as shown in FIGS. 6 and 7, opens the lid 44, folds it back to the rear side and then inserts an insertion portion 444 of the lid 44 into a third slit 45 formed in a bottom portion 40 that will be described later. In this manner, the sheets 7 stored inside become exposed. A sheet package 9 in this condition is set in the sheet storage portion 6 of the printer 1. In the following description, an end of the sheet package 9, that is to be placed on the side of the printer mechanism portion 14 when the sheet package 9 is set in the printer 1, is referred to as a front end, an end on the opposite side thereof is referred to as the rear end, and the other two opposing ends are referred to as side ends.

Next, the structure of the package member 8 will be described with reference to FIGS. 8 and 9. The package member 8 is formed by punching out a flat cardboard material, and has a bottom portion 40, side wall portions 41-43, a lid portion 44, a first wrapping portion 50, a second wrapping portion 60, and a tongue portion 70. The bottom portion 40, which covers one face of the stacked sheets 7 in the stacking direction, is provided in the center of the package member 8. To one of a pair of side ends of the bottom portion 40, a rectangular side wall portion 41 is continuously formed, while to the other side end of the bottom portion 40, another rectangular side wall portion 42 is continuously formed. In addition, to the rear end of the bottom portion 40, still another rectangular side wall portion 43 is continuously formed. The heights (length in a shorter side direction) of the side wall portions 41-43 are all equal, and are greater than the stacking height of the sheets 7 stored in the sheet package 9.

Figure 8:
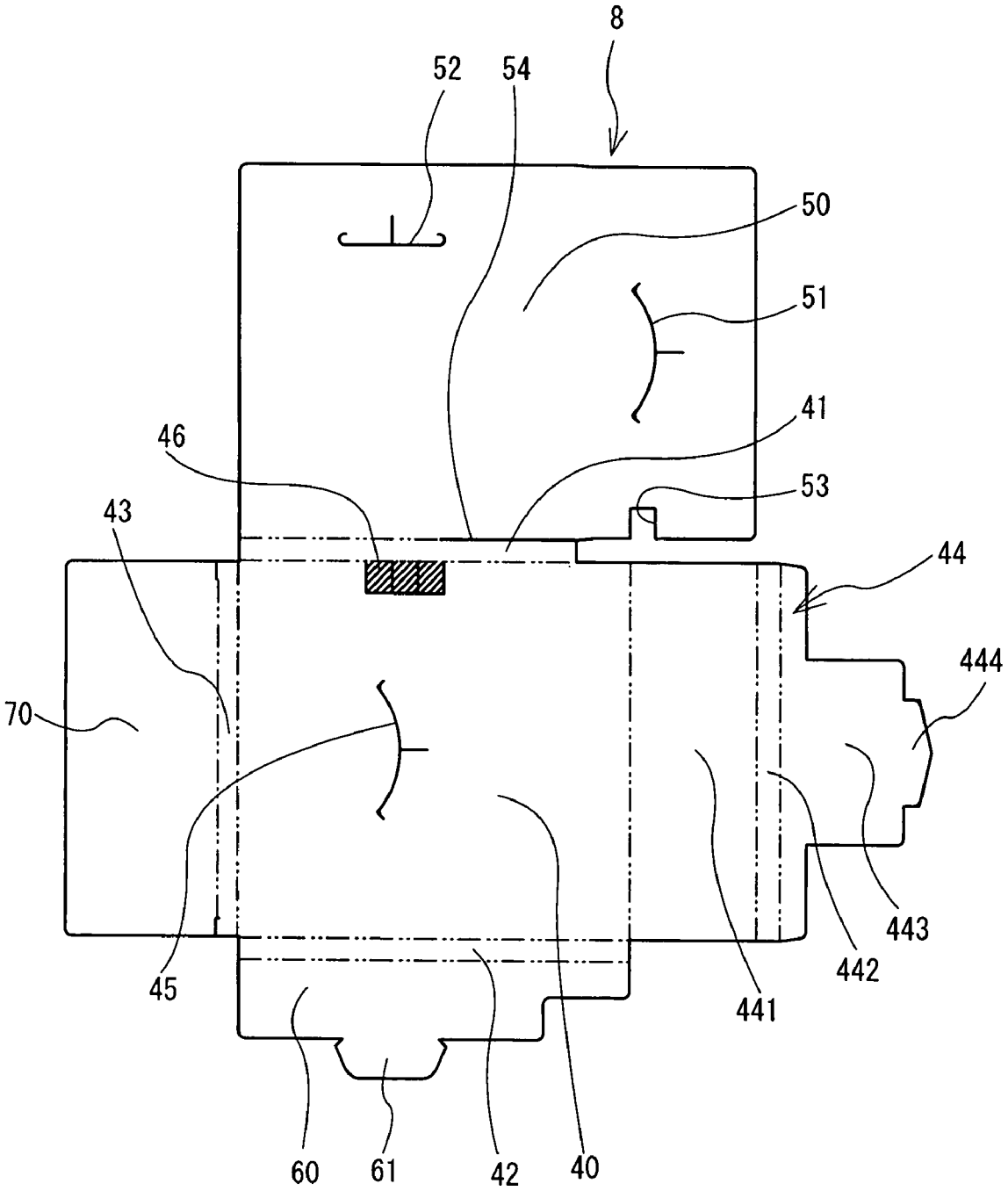
FIG. 8 is a developed view of the sheet package showing an outer surface.
Figure 9:
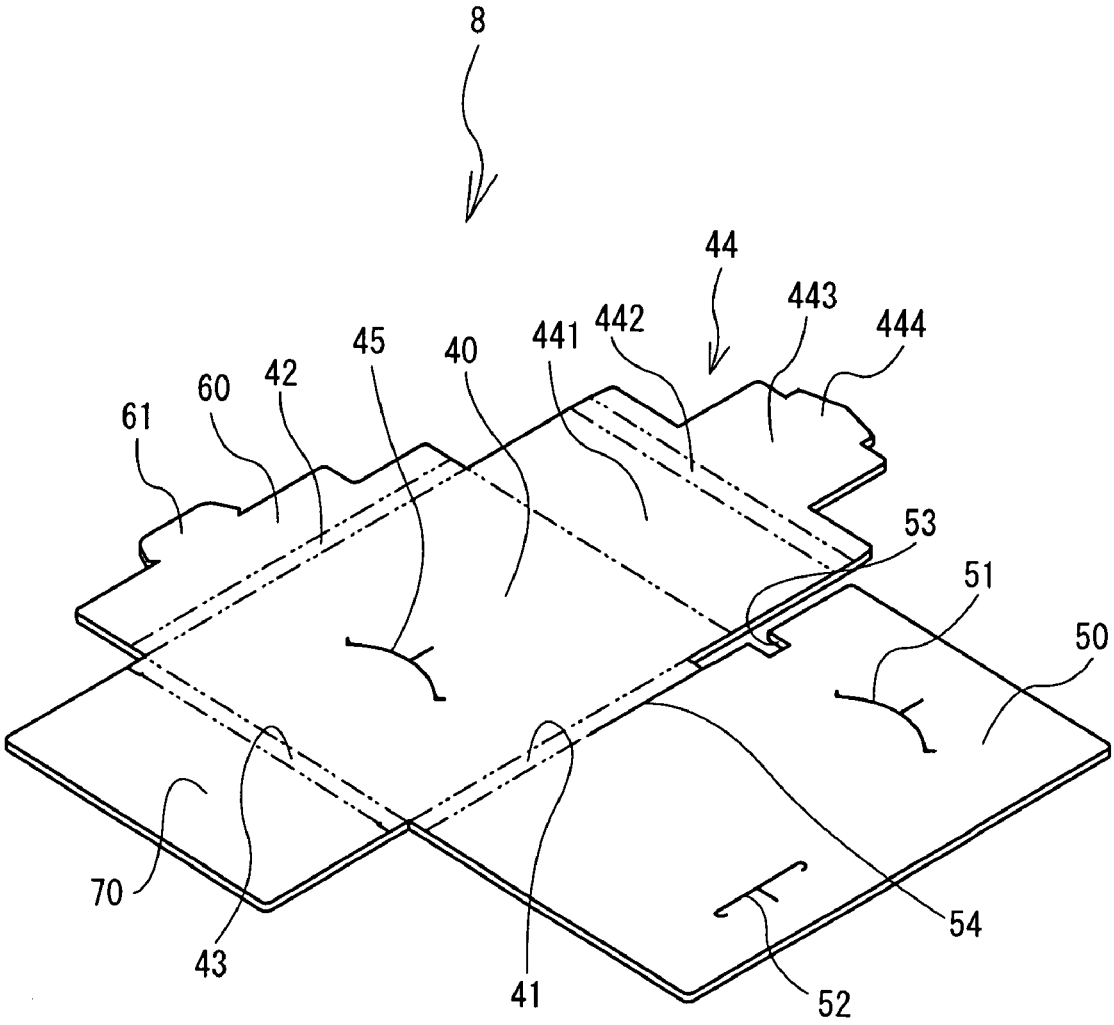
FIG. 9 is a perspective developed view of the sheet package showing an inner surface.

As shown in FIGS. 8 and 9, to the front end of the bottom portion 40, the lid portion 44 is continuously formed. The lid portion 44 has a rectangular lid base portion 441, a lid side wall portion 442, a flap portion 443 and an insertion portion 444. The rectangular lid side wall portion 442 is formed continuously to the lid base portion 441 and has a height (length in the shorter side direction) that is identical to the height of the aforementioned side wall portions 41-43. The flap portion 443 is connected to the lid side wall portion 442 and has a width that is less than that of the lid side wall portion 442. The insertion portion 444 is further connected to the flap portion 443, and has a width that is less than that of the flap portion 443 and is provided with a pair of tilted sides. A shape of the bottom portion 40 as combined with the lid base portion 441 is substantially the same as that of the sheet 7.

As shown in FIGS. 8 and 9, to the side wall portion 41, a rectangular first wrapping portion 50 is continuously formed. The first wrapping portion 50 is placed to face the bottom portion 40 and covers the sheets 7 after manufacturing. The first wrapping portion 50 has a first slit 51 in which the insertion portion 44 of the lid portion 44 is to be inserted and a second slit 52 in which an insertion portion 61 of the second wrapping portion 60, which will be described later, is inserted. A square cutout portion 53 is provided on a side end of the first wrapping portion 50 opposing to the lid base portion 441. With the use of this cutout portion 53, the printer 1 detects the presence or absence of the sheet 7. Specifically, The sheet package 9 is loaded in the sheet storage portion 6 of the printer 1 in the state shown in FIG. 6. The printer 1 has a reflection type optical sensor 80 (see FIGS. 3 and 4) at a position facing the cutout portion 53. Thus, as long as any sheet 7 exists in the sheet package 9, the reflection type optical sensor detects the reflection of light from the sheet 7. On the other hand, when the sheet 7 is no longer there, the reflection type optical sensor detects a reflected light from the synthetic resin constituting the pressure plate 18 of the lid 10. Thus, if the color of the synthetic resin constituting the pressure plate 18 of the lid 10 has a low light reflection factor, the presence or absence of a sheet can be detected easily.

As shown in FIG. 8, on the outer surface of the package member 8, along a side end of the bottom portion 40 connecting to the side wall portion 41 and the first wrapping portion 50, three sensor marks 46 are printed to indicate the kinds and sizes of sheets 7 stored in the sheet package 9. The sensor marks 46 are read by a reflection type optical sensor provided in the printer 1, a sensor (not shown) that is different from the reflection type optical sensor 80. For example, on the assumption that a presence of the sensor mark 46 represents "1", while an absence thereof represents "0", eight kinds of sheets 7 can be distinguished by means of these three sensor marks 46. In the bottom portion 40 a third slit 45 is formed in which the insertion portion 444 of the folded back lid portion 44 can be inserted. Further, a cut-in portion 54 is cut between the side wall portion 41 and the first wrapping portion 50 to a predetermined length from the cutout portion 53 side. The cut-in portion 54 facilitates distortion of the first wrapping portion 50 when the sheet package 9 is loaded in the sheet storage portion 6 and the first wrapping portion 50 is pressed by the pressure plate 18, and the sheets 7 stored in the sheet package 9 can be pressed against the pickup roller 12 with a sufficient degree of force. Further, when the lowermost sheet 7 that makes direct contact with the pickup roller 12 is fed by driving of the pickup roller 12, friction generated between the first wrapping portion 50 and the uppermost sheet 7 in contact with the first wrapping portion 50 functions to hold other sheets 7 and prevent them from being fed together. Thus, By facilitating distortion of the first wrapping portion 50, friction force between the first wrapping portion 50 and the sheet 7 is increased, thereby avoiding feeding multiple sheets at a time but feeding the sheets one by one without fail.

As shown in FIGS. 8 and 9, to the side wall portion 42, a second wrapping portion 60 is continuously formed. The second wrapping portion 60 faces the bottom portion 40 and fixes the first wrapping portion 50 covering the sheets 7 after manufacturing. The width of the second wrapping portion 60 is narrower than that of the first wrapping portion 50 and has an insertion portion 61 at a side end. When the sheet package 9 is manufactured, this insertion portion 61 is inserted into the second slit 52 of the first wrapping portion 50 so as to fix the first wrapping 50.

As shown in FIGS. 8 and 9, to the side wall portion 43, a rectangular tongue portion 70 is continuously formed. The tongue portion 70 serves to receive the bottom end of the stacked sheets 7 in the process of manufacturing the sheet package 9. In FIGS. 8 and 9, two-dot chain lines indicate lines subjected to fold line processing in order to facilitate folding of the cardboard material along the fold lines, for convenience of manufacturing.

Figure 10:
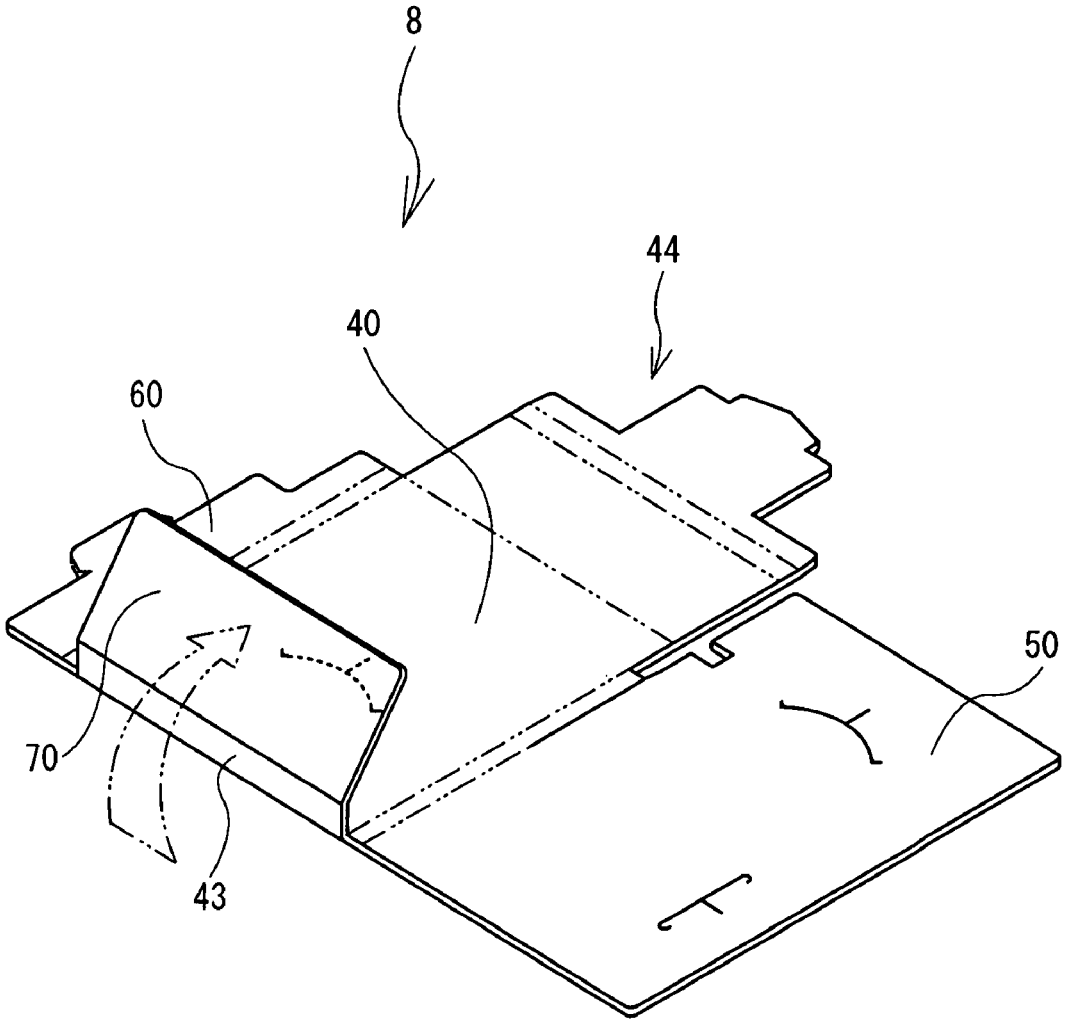
FIGS. 10 through 14 are perspective views showing a process of manufacturing the sheet package.
Figure 11:
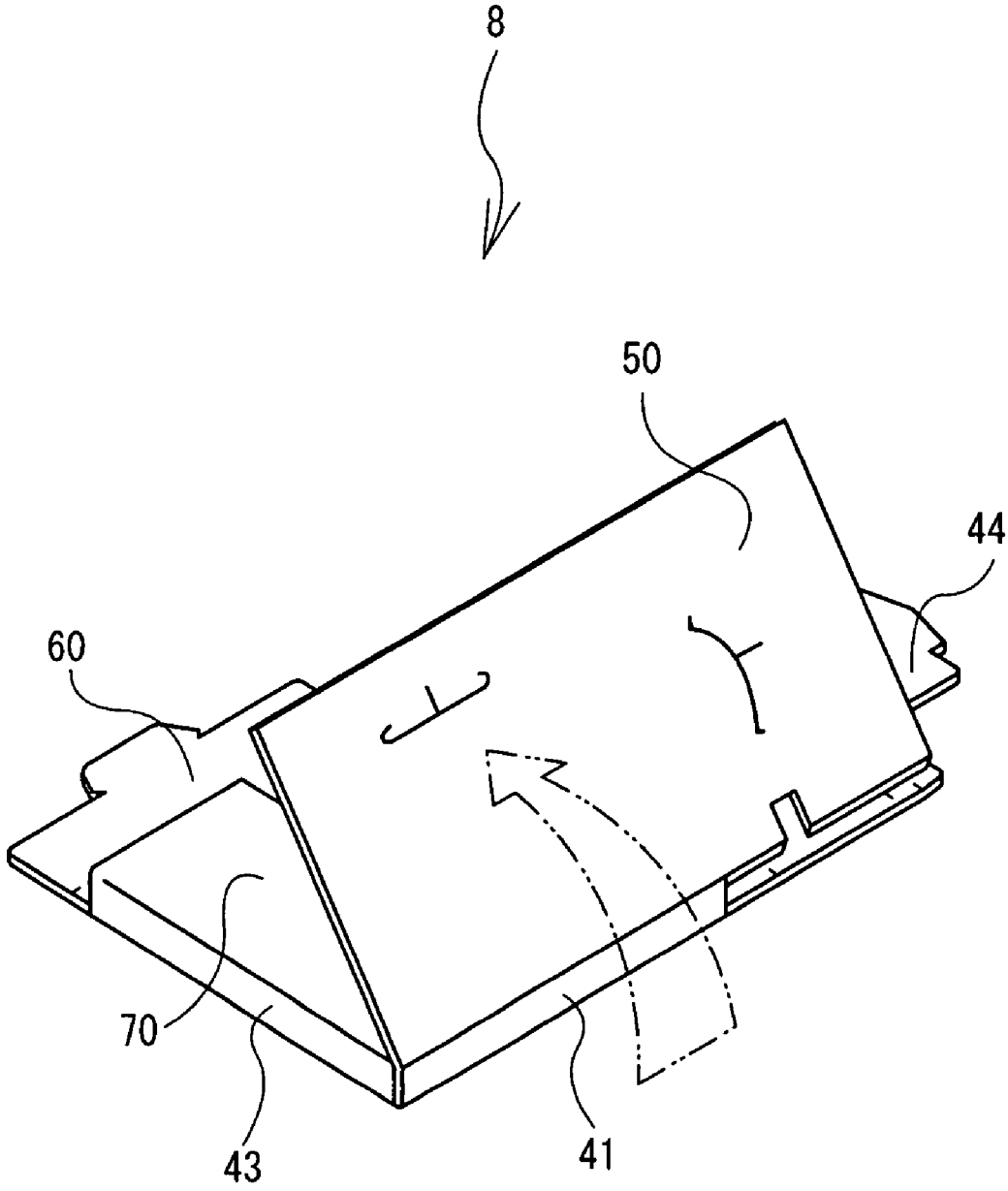
Figure 12:
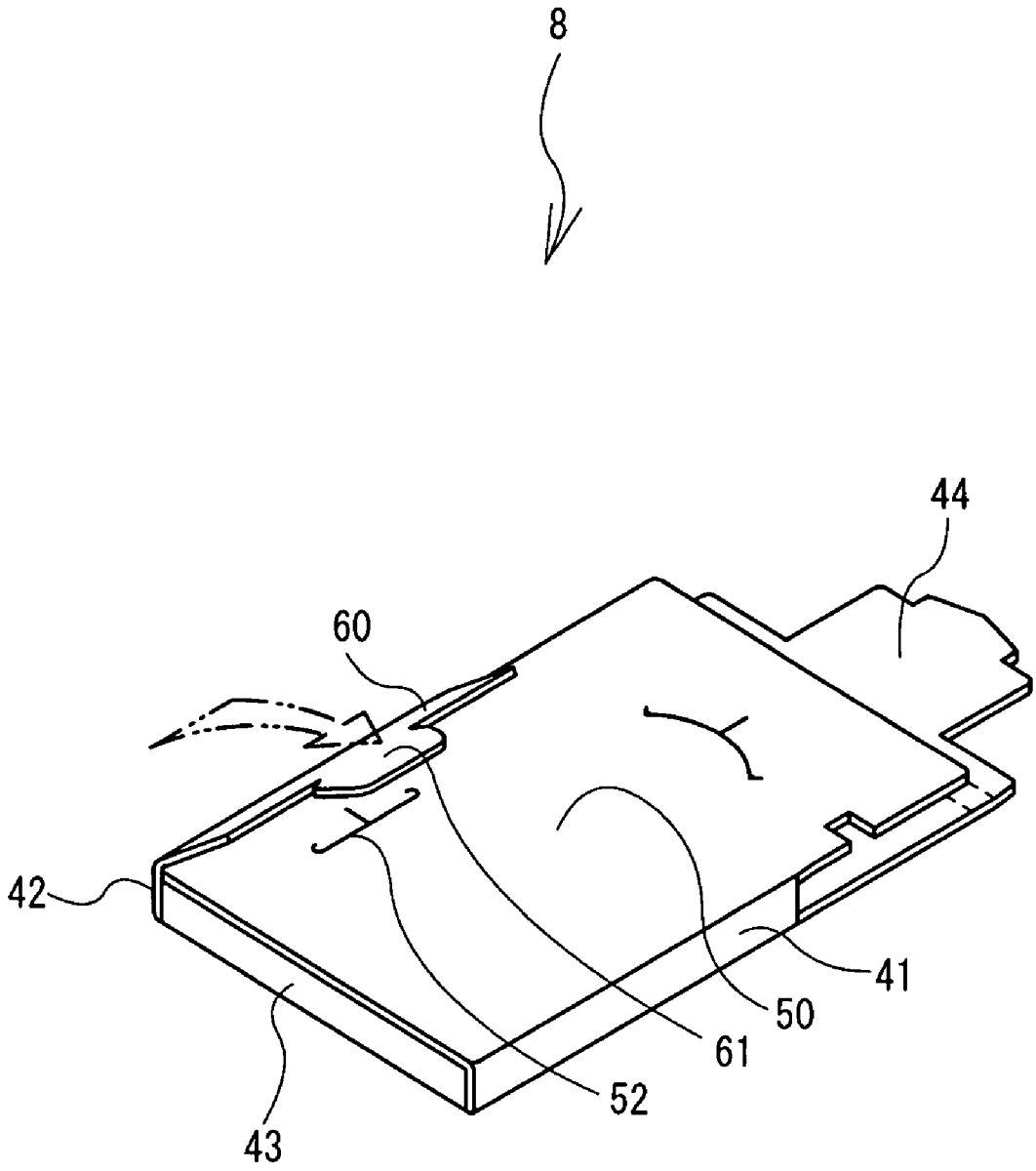
Figure 13:
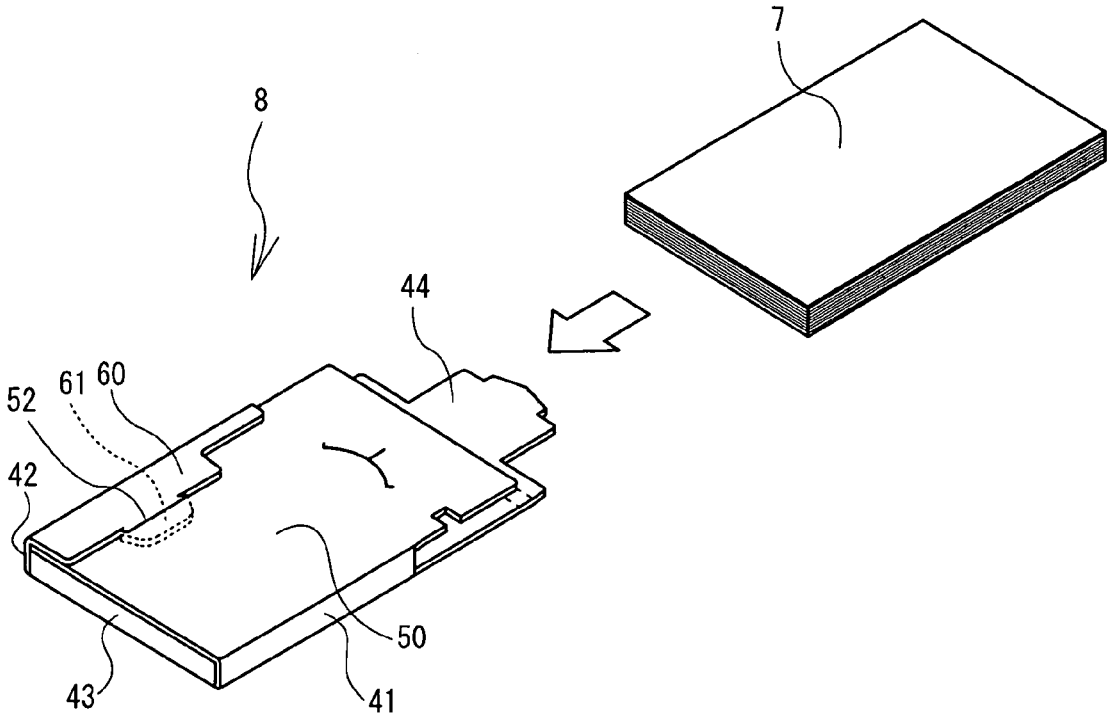

Next, a process of manufacturing the sheet package 9 will be described with reference to FIGS. 10-14. First, as shown in FIG. 10, the side wall portion 43 of the package member 8 is folded upwards and further, the tongue portion 70 is folded at a right angle from the side wall portion 43 so as to face the bottom portion 40. Next, as shown in FIG. 11, the side wall portion 41 is folded upwards and further, the first wrapping portion 50 is folded at a right angle from the side wall portion 41 so as to be overlapped on the tongue portion 70. Next, as shown in FIG. 12, after the side wall portion 42 has been folded upwards, the second wrapping portion 60 is folded over the first wrapping portion 50 and then, the insertion portion 61 of the second wrapping portion 60 is inserted into the second slit 52 of the first wrapping portion 50. Then, as shown in FIG. 13, the stacked sheets 7 are inserted into the package member 8 in this condition. The sheets 7 may be placed onto the bottom portion 40 of the package member 8 before the tongue portion 70 is folded, and after that, the tongue portion 70 may be folded.

Figure 14:
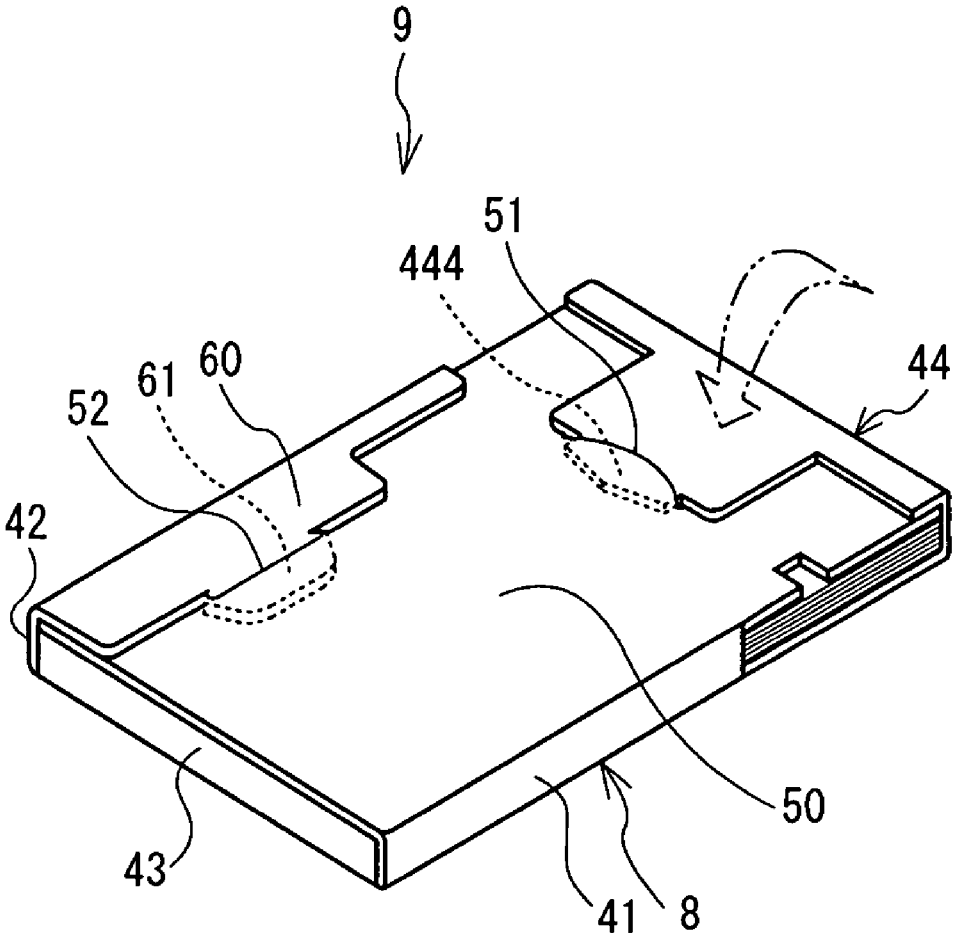

Finally, as shown in FIG. 14, the lid portion 44 is folded over the first wrapping portion 50 and then, the insertion portion 444 of the lid portion 44 is inserted into the first slit 51 in the first wrapping portion 50 so as to complete the sheet package 9. The sheet packages 9 are put on sale in this condition.

Figure 15:
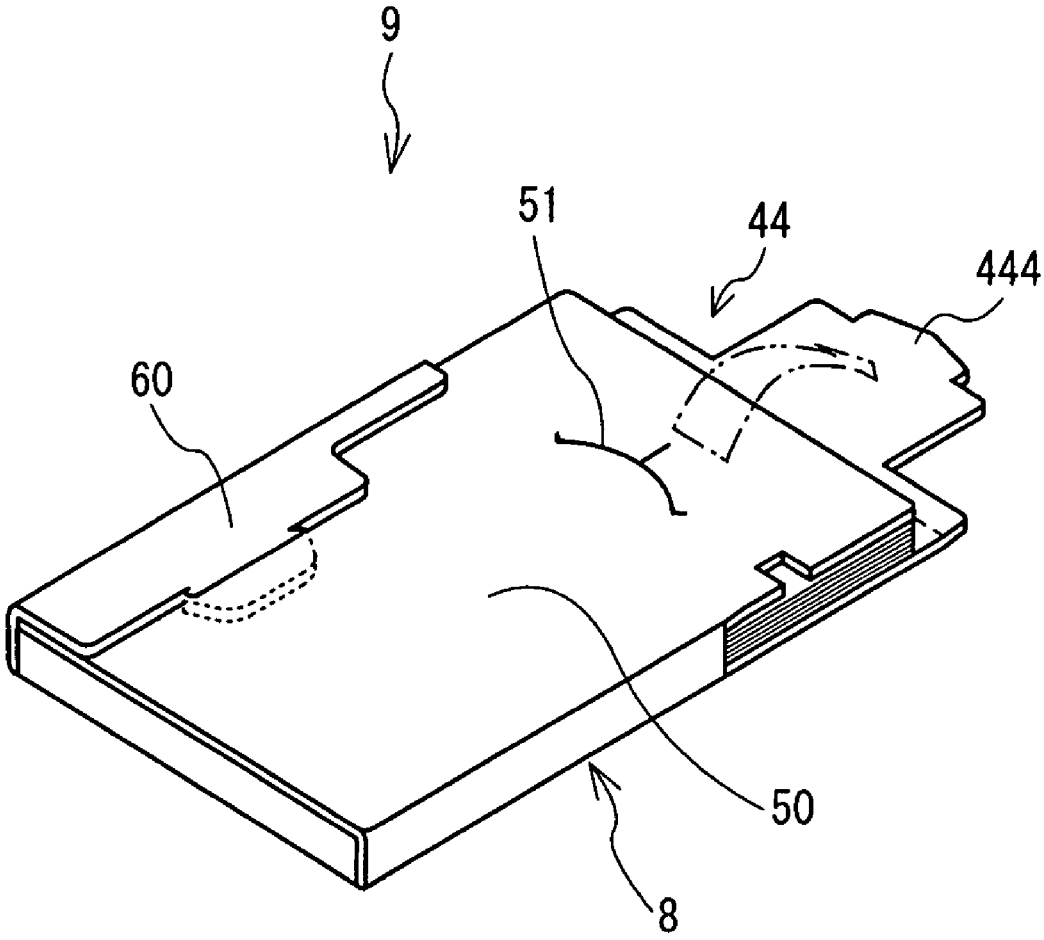
FIGS. 15 and 16 are perspective views showing a procedure for opening a the sheet package upon use.
Figure 16:
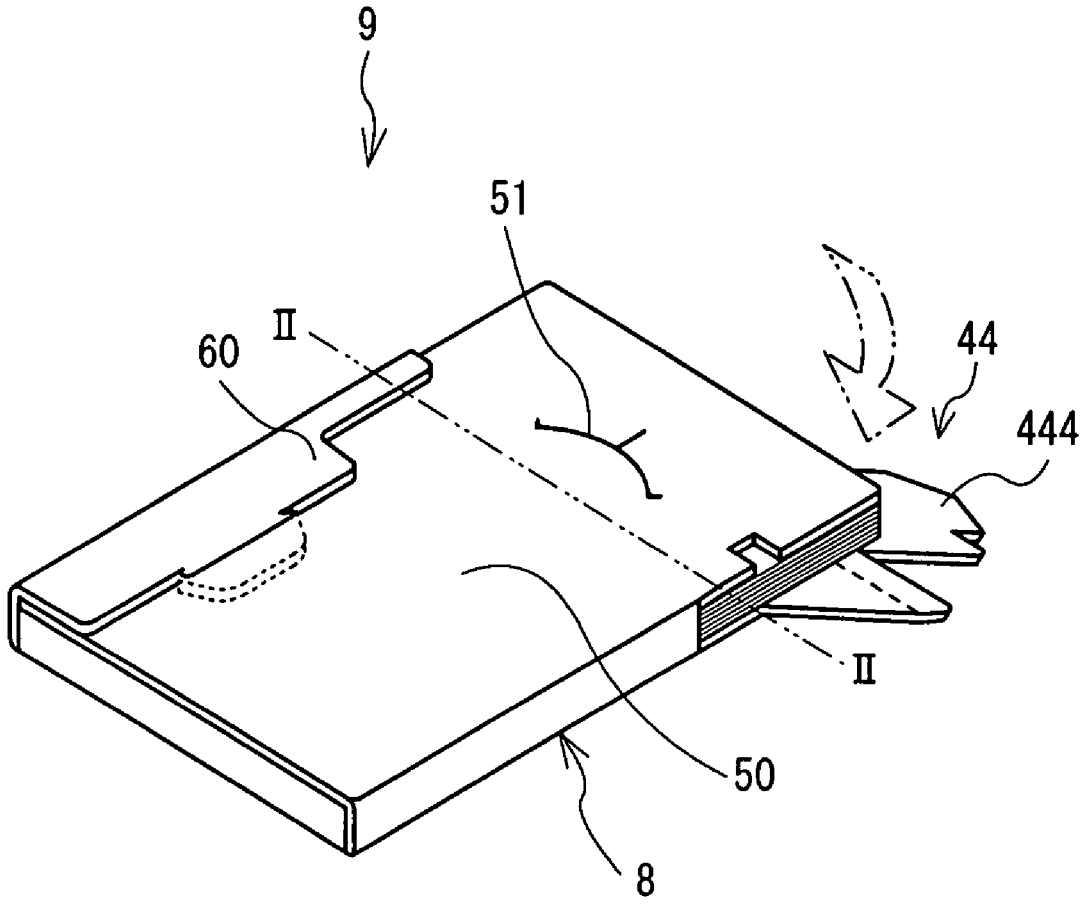
Figure 17:
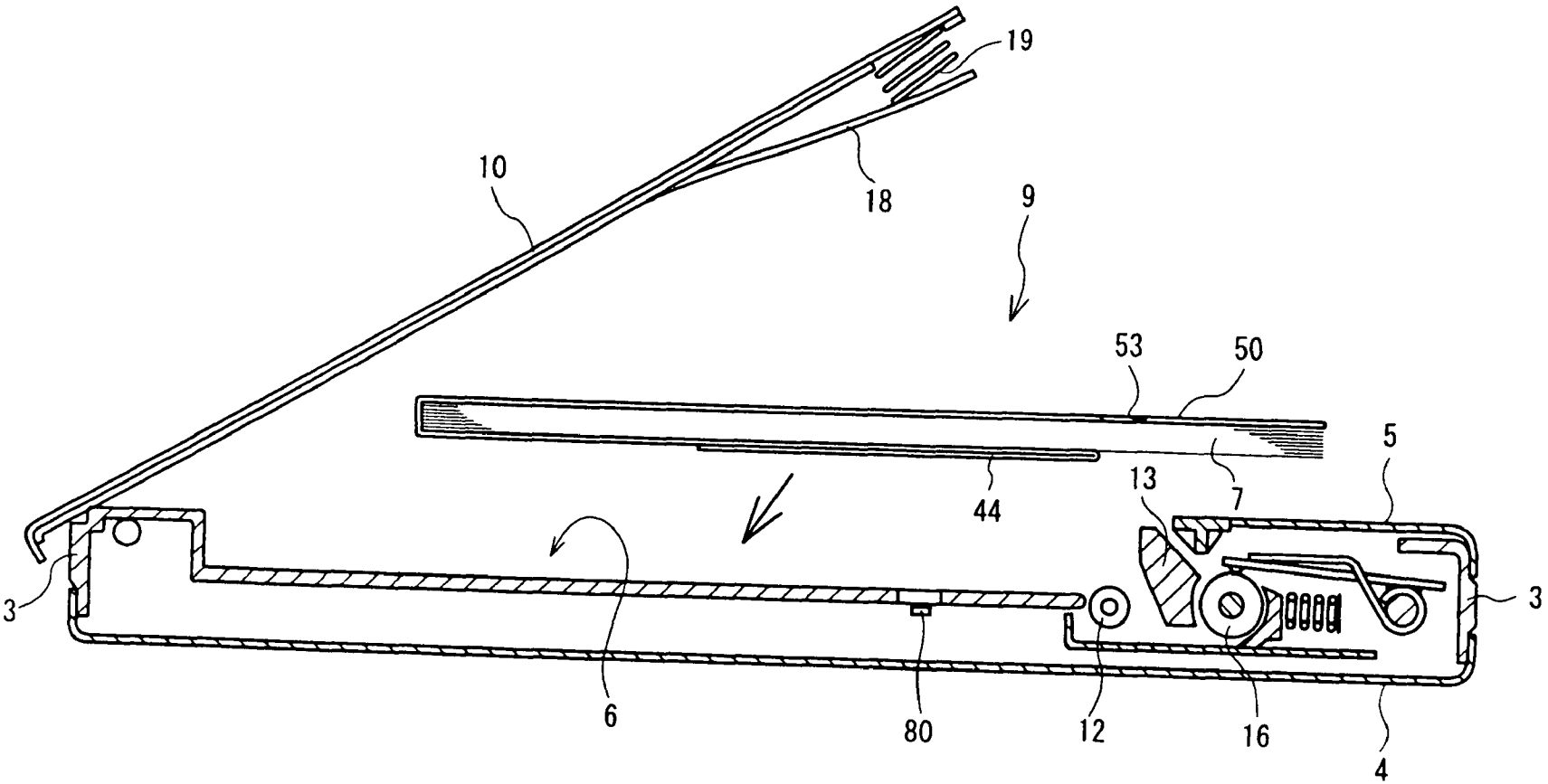
FIG. 17 is a sectional view showing a procedure for setting the sheet package in a printer.

A usage method of the sheet package 9 will next be described with reference to FIGS. 5, 6, 7, 15, 16 and 17. When the sheet package 9 is used, first, the lid portion 44 of the sheet package 9 in the condition shown in FIG. 5 is raised as shown in FIG. 15 and then, as shown in FIGS. 16 and 6, folded back to the rear side along the line II-II shown in FIG. 16. Then, as shown in FIG. 7, the insertion portion 444 of the flap portion 443 is inserted into the third slit 45 of the bottom portion 40 so as to fix the lid portion 44 to the bottom portion 40. The sheet package 9 in this condition is loaded in the sheet storage portion 6 of the printer 1, as shown in FIG. 17. Then, when the lid 10 is closed, the first wrapping portion 50 of the sheet package 9 is pressed by the pressure plate 18 so that the lowermost sheet of the stacked sheets 7 is pressed against the pickup roller 12.

At this time, the reflection type optical sensor 80 provided on the printer 1 comes to face the cutout portion 53 provided on the first wrapping portion 50 of the sheet package 9 (see FIGS. 3 and 4). Therefore, when any sheet 7 exists in the sheet package 9, the reflection type optical sensor 80 detects reflection light from the sheet 7. On the other hand, when the sheets 7 have been used up, the reflection type optical sensor 80 detects reflection light from the synthetic resin constituting the pressure plate 18 of the lid 10.

As described above, in the sheet package 9 of the first embodiment, the first wrapping portion 50 is provided with a cutout portion 53 for detecting a presence or an absence of the sheets 7. Accordingly, the reflection type optical sensor 80 can immediately detect that the sheets 7 are used up and no sheets are left. Moreover, the first wrapping portion 50 occupying a large area is extended from the side end of the bottom portion 40. Accordingly, with regards to the size of cardboard material from which the package member is to be cut out, the length in a longitudinal direction is not required to become as large as in the case where the first wrapping portion 50 is extended from the rear end. Further, the amount of cardboard material that needs to be cut off to be wasted can be reduced.

Figure 18:
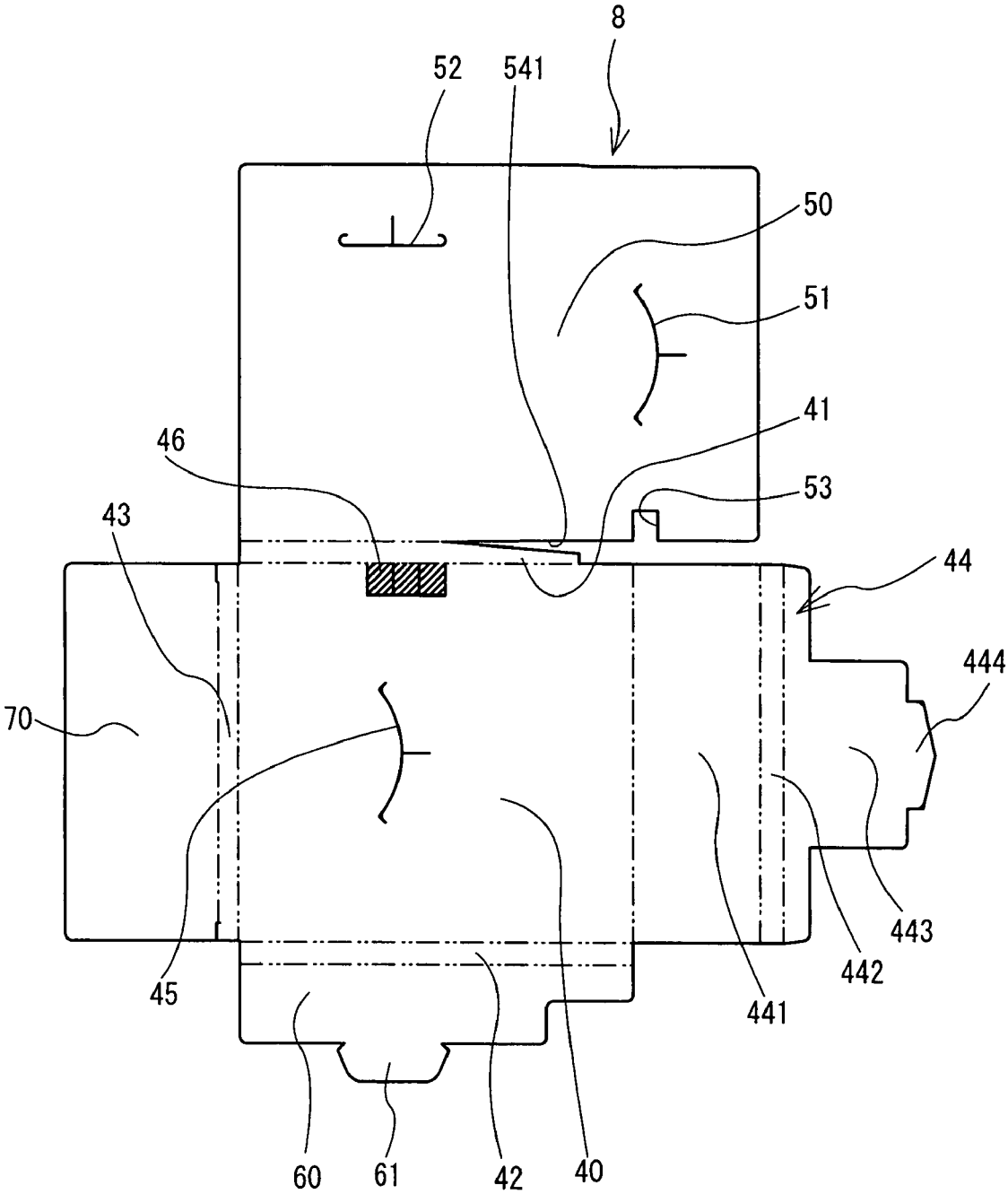
FIG. 18 is a developed view of a package member of the sheet package according to a second embodiment as seen from the exterior.

Next, the second embodiment of the sheet package 9 will be described with reference to FIG. 18. The package member 8 of the second embodiment shown in FIG. 18 has a substantially identical shape to that of the package member 8 of the first embodiment. Therefore, only different portions will be described. A cut-in portion 541 which is cut out in a V-shape at a predetermined length from the cutout portion 53 is provided at a connecting portion between the side wall portion 41 and the first wrapping portion 50. In the package member 8 of the first embodiment shown in FIG. 8, the cut-in portion 54 is formed by cutting a connecting line between the side wall portion 41 and the first wrapping portion 50 linearly to a predetermined length from the cutout portion 53. On the other hand, in the package member 8 of the second embodiment, the V-shaped cut-in portion 541 is formed by cutting out a part of the side wall portion 41. A width of the cut-in portion 541 at an opening end is set to be greater than the thickness of the sheet material (cardboard material) that constitutes the package member 8.

Accordingly, when the sheet package 9 of the second embodiment is loaded in the sheet storage portion 6 and the first wrapping portion 50 is pressed by the pressing plate 18, distortion (movement) of the first wrapping portion 50 can be facilitated. In addition, the V-shaped cut-in portion 541 is formed by cutting out a part of the side wall portion 41, and the width of the cut-in portion 541 at the opening end is set to be greater than the thickness of the sheet material (cardboard material) that constitutes the package member 8, thereby preventing the first wrapping portion 50 from hitting the side wall portion 41. Consequently, smooth movement of the first wrapping portion 50 can be ensured. Thus, the pressing of the sheets 7 stored in the sheet package 9 against the pickup roller 12 can be achieved with an adequate degree of force. As a result, the individual sheets 7 can be fed on by one without fail, and feeding of plural sheets at one and the same time can be prevented as in the first embodiment of the sheet package 9.

Figure 19:
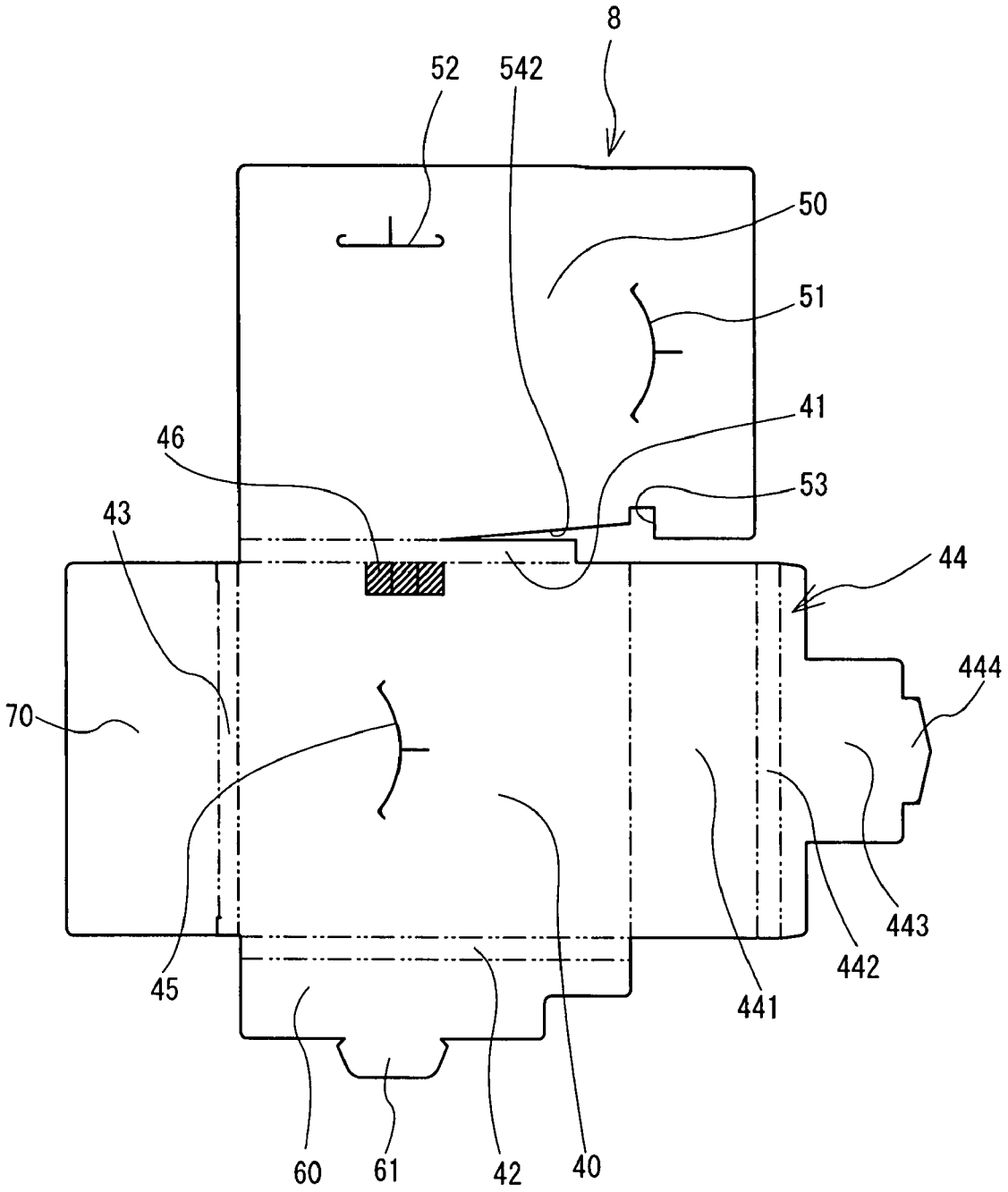
FIG. 19 is a developed view of a package member of the sheet package according to a third embodiment as seen from the exterior.

Next, a third embodiment of the sheet package 9 will be described with reference to FIG. 19. As shown in FIG. 19, the package member 8 of the third embodiment has a substantially identical shape to that of the package member 8 of the first or second embodiment. Therefore, only different portions will be described. In the package member 8 of the third embodiment, a V-shaped cut-in portion 542 is provided at a connecting portion between the side wall portion 41 and the first wrapping portion 50, by cutting out that portion to a predetermined length from the cutout portion 53. In the package member 8 of the third embodiment, a V-shaped cut-in portion 542 is formed by cutting out a part of the first wrapping portion 50. Moreover, the width of the cut-in portion 542 at an opening end is set to be greater than the thickness of the sheet material (cardboard material) that constitutes the package member 8.

Thus, in the sheet package 9 of the third embodiment, when the sheet package 9 is loaded on the sheet storage portion 6, and then the first wrapping portion 50 is pressed by the pressing plate 18, distortion (movement) of the first wrapping portion 50 can be facilitated. Further, the V-shaped cut-in portion 542 is formed by cutting out apart of the first wrapping portion 50, and the width of the cut-in portion at the opening end is set larger than the thickness of the sheet material (cardboard material) that constitutes the package member 8, thereby preventing the cut-in portion 542 of the first wrapping portion 50 from hitting the side wall portion 41. As a result, smooth movement of the first wrapping portion 50 can be achieved. Thus, the pressing of the sheets 7 stored in the sheet package 9 against the pickup roller 12 can be achieved with an adequate degree of force. Consequently, the individual sheets 7 can be fed one by one without fail and feeding of plural sheets at one and the same time can be prevented as in the first embodiment of the sheet package 9.

Figure 20:
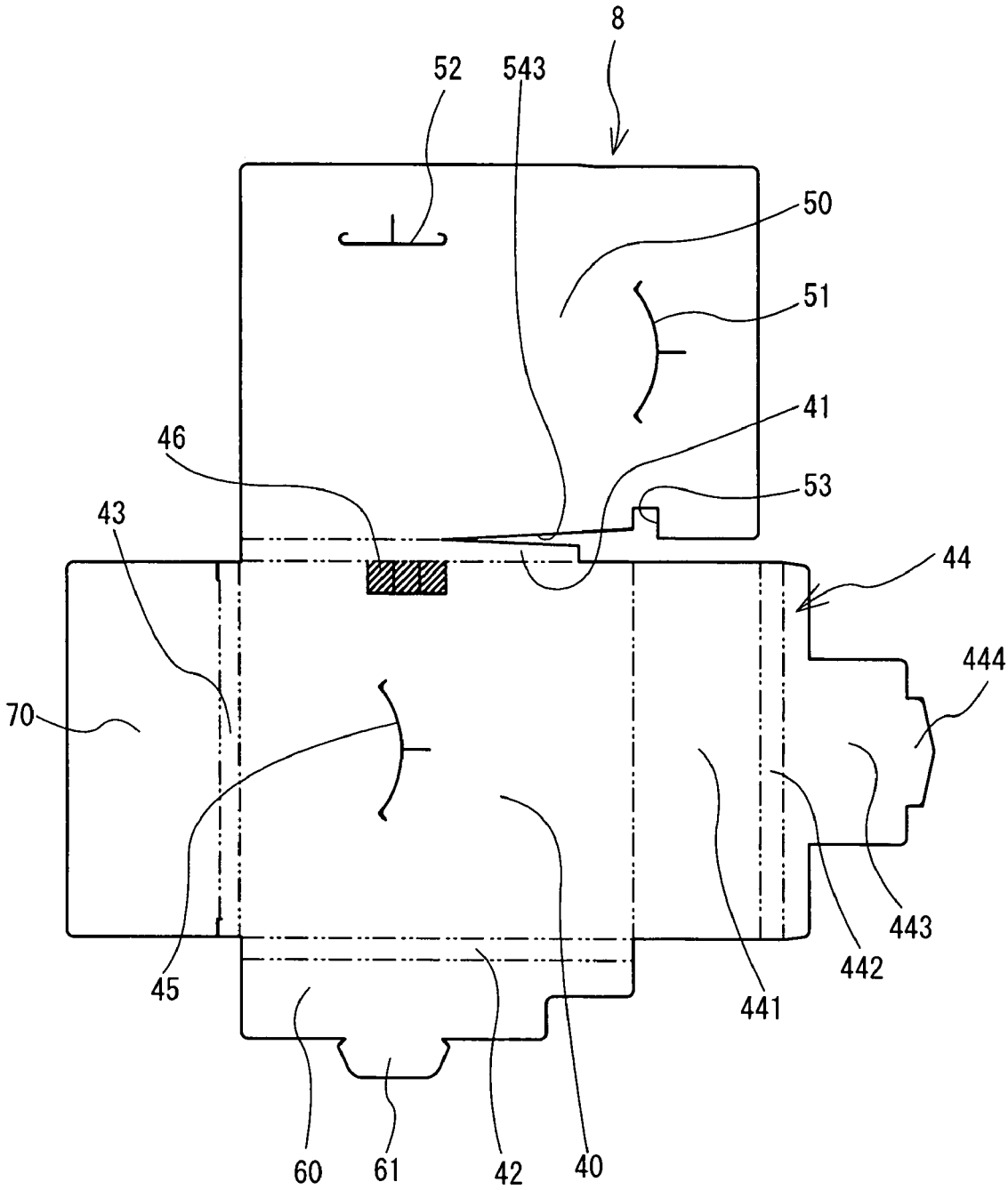
FIG. 20 is a developed view of a package member 8 of the sheet package according to a fourth embodiment as seen from the exterior.

Next, a fourth embodiment of the sheet package 9 will be described with reference to FIG. 20. As shown in FIG. 20, the package member 8 of the fourth embodiment has a substantially identical shape to that of the package member 8 of any of the first through third embodiments. Therefore, only different portions will be described. In the package member 8 of the fourth embodiment, a V-shaped cut-in portion 543 is provided at a connecting portion between the side wall portion 41 and the first wrapping portion 50 extending for a predetermined length from the cutout portion 53. IN the fourth embodiment, a V-shaped cut-in portion 543 is formed by cutting out a part of the first wrapping portion 50 as well as a part of the side wall portion 41 of the package member 8. Moreover, the width of the cut-in portion 543 at the opening end is set so as to be greater than the thickness of the sheet material (cardboard material) that constitutes the package member 8.

Thus, in the sheet package 9 of this fourth embodiment, when the sheet package 9 is loaded in the sheet storage portion 6 and then, the first wrapping portion 50 is pressed by the pressure plate 18, distortion (movement) of the first wrapping portion 50 can be facilitated. Further, a cut-in portion 543 is formed by cutting out both a part of the first wrapping portion 50 and a part of the side wall portion 41 in a V-shape and the width of the cut-in portion 543 at the opening end is set so as to be greater than the thickness of the sheet material (cardboard material) that constitutes the package member 8, thereby preventing the first wrapping portion 50 from hitting the side wall portion 41. As a result, smooth movement of the first wrapping portion 50 can be achieved. Thus, the pressing of the sheets 7 stored in the sheet package 9 against the pickup roller 12 can be achieved with an adequate degree of force. Consequently, the individual sheets 7 can be fed one by one without fail and feeding of plural sheets at one and the same time can be prevented as in the first embodiment of the sheet package 9.

The present invention is not restricted to the above-described embodiments but can be modified in various ways. For example, the cutout portion 53 need not be limited to a cutout but may also be a hole made in the first wrapping portion 50. In other words, anything can be used as long as it is capable of transmitting light emitted by the reflection type optical sensor 80. Further, a cutout portion 54 may be formed in the connecting portion between the bottom portion 40 and the side wall portion 41. In this case, the V-shaped cutout may be formed at the side wall portion 41, either at the bottom portion 40 or at both the side wall portion 41 and the bottom portion 40. A narrow cutout shape of a predetermined width may also be used instead of the V-shape.

What is claimed is:

1. A sheet package that can be set in a printer for supplying the printer with sheets as print media, comprising:

a stack of sheets stacked in a stacking direction; and a package member covering an exterior of the stack of sheets;

wherein the package member includes:

a rectangular first portion that covers a part of one face of the stack of sheets on one side in the stacking direction;

a second portion that covers the other face of the stack of sheets on the other side in the stacking direction and facing the first portion;

a third portion that covers a side face of the stack of sheets, the third portion connected with the first portion via one of a pair of side ends of the first portion, and the third portion connected with the second portion via one of a pair of side ends of the second portion; and a cut-in portion formed on a boundary between the second portion and the third portion, the cut-in portion extending along the boundary between the second portion and the third portion for a predetermined length;

wherein the third portion is continuous and does not extend along the full length of the one of the pair of side ends of the second portion connected to the third portion, so that the second portion has a free side end at the one of the pair of side ends of the second portion not connected with the third portion.

2. The sheet package according to claim 1, wherein the cut-in portion has a width at an opening end that is greater than the thickness of the material of the package member.

3. The sheet package according to claim 1, wherein a square cut-out portion is provided at the free side end of the second portion connected with the third portion for detecting the presence or absence of sheets.

4. The sheet package according to claim 3, wherein the predetermined length extends from an end of the free side end that includes the square cut-out portion.

5. The sheet package according to claim 1, wherein the cut-in portion is formed by cutting out a part of the third portion.

6. The sheet package according to claim 1, wherein the cut-in portion is formed by cutting out a part of the second portion.

7. The sheet package according to claim 1, wherein the cut-in portion is formed by cutting out both a part of the second portion and a part of the third portion.

* * * * *